US007057122B1

(12) United States Patent
Mizuno et al.

(10) Patent No.: US 7,057,122 B1
(45) Date of Patent: Jun. 6, 2006

(54) MULTI-MODE REMOTE CONTROLLER

(75) Inventors: Yuji Mizuno, Chula Vista, CA (US); Minh Nguyen, Chula Vista, CA (US)

(73) Assignee: SMK Manufacturing Inc., Chula Vista, CA (US)

( * ) Notice: Subject to any disclaimer, the term of this patent is extended or adjusted under 35 U.S.C. 154(b) by 0 days.

(21) Appl. No.: 11/109,868

(22) Filed: Apr. 20, 2005

(51) Int. Cl.
*H01H 27/00* (2006.01)

(52) U.S. Cl. ..... 200/43.04; 200/43.07; 200/573; 200/574; 200/330; 200/331

(58) Field of Classification Search ..... 200/17 R, 200/42.02, 43.01, 43.04, 43.07, 573, 574, 200/329–334, 16 R–16 D, 52 R
See application file for complete search history.

(56) References Cited

U.S. PATENT DOCUMENTS 4,455,546 A * 6/1984 Roszel ..... 200/330
5,357,070 A * 10/1994 Parsons, Jr. ..... 200/331
6,027,234 A * 2/2000 Austin ..... 200/332.1
6,204,461 B1 * 3/2001 Bucher et al. ..... 200/330
6,376,790 B1 * 4/2002 Kawase ..... 200/547

* cited by examiner

*Primary Examiner*—Michael A. Friedhofer
(74) *Attorney, Agent, or Firm*—Westerman, Hattori, Daniels & Adrian, LLP

(57) ABSTRACT

A remote controller has a sliding switch which has more than two contacting positions linearly disposed, and a sliding lever to switch among the contacting positions. A slider engaged with the sliding lever and the slider has an angle portion. A first cam piece has a first V-shaped notch to fit the angle portion of the slider. The first cam piece corresponds to one or two of the contacting positions located in a central portion of the sliding switch. A second cam piece has a second V-shaped notch to fit the angle portion. The second cam piece corresponds to two of the contacting positions located on side portions of the sliding switch.

7 Claims, 7 Drawing Sheets

MULTI-MODE REMOTE CONTROLLER

FIELD OF INVENTION

This invention relates to a remote controller used for equipment such as television sets and audio visual devices. More specifically, this invention relates to a remote controller capable of setting more than two modes.

BACKGROUND OF THE INVENTION

Remote controllers are used for equipment such as television sets and audio visual devices. Most remote controller need to be switched to a plurality of different modes. Some modes do not need to frequently be switched to and from other modes very frequently.

For example, consider a satellite box set which has two or more tuners. The users of the box set do not need separate satellite box sets to see two or more different programs in different rooms. They can use a single box set with two or more tuners and the same remote controllers. Each of the remote controllers operates each of the tuners in the box set with an RF wave. In order to avoid interference between the RF waves of the remote controllers, the remote controllers have RF waves for different modes. In this way, users can save the space to install the box set in each room.

Once the remote controllers are set for each different mode, users usually do not switch the remote controllers to another mode. Therefore, it is not preferable to put a button on the remote controller surface for such modes which do not require frequent switching. Adding buttons complicates the layout of the remote controller, causing unnecessary inconveniences for the user. It also increases difficulty in designing arrangement of buttons of the remote controller.

In general, a remote controller having a two position sliding switch is known wherein the two positions of the sliding switch correspond to two modes and the two positions are set by a first side and a second side of a cam piece. However, such remote controllers cannot switch among two or more different modes.

SUMMARY OF THE INVENTION

A remote controller according to the present invention has a sliding switch. The sliding switch can be used to switch between modes. The sliding switch includes two or more contacting positions which are linearly disposed. The sliding contact has a slider with an angle portion. Two or more cam pieces with a V-shaped notch can be used for switching the sliding switch.

A first cam piece has a notch to fit the angle portion of the slider of the sliding contact. The first cam corresponds to one or two of the contacting positions located in a central portion of the sliding switch. If the first cam piece has a notch slightly off the center, the first cam piece has two positions corresponding to the central two contacting positions of the sliding switch, one corresponding to a first side and the other to a second reverse side of the first cam piece.

Similarly, the second cam piece has a notch to fit the angle portion of the slider. The second cam piece has the notch more remote from the notch of the first cam piece corresponding to slide positions of the switch.

Thus, if the first cam piece has only one corresponding contact position, the two cam pieces can switch three sliding positions of the sliding switch. If the first cam piece has two corresponding contact positions, then the two cam pieces can switch four sliding positions. It is also possible to switch more than four sliding positions using more than two cam switches.

BRIEF DESCRIPTION OF THE DRAWINGS

A preferred embodiment of the present invention will be described with reference to the accompanying drawings, wherein.

DETAILED DESCRIPTION OF THE INVENTION

Figure 1A:
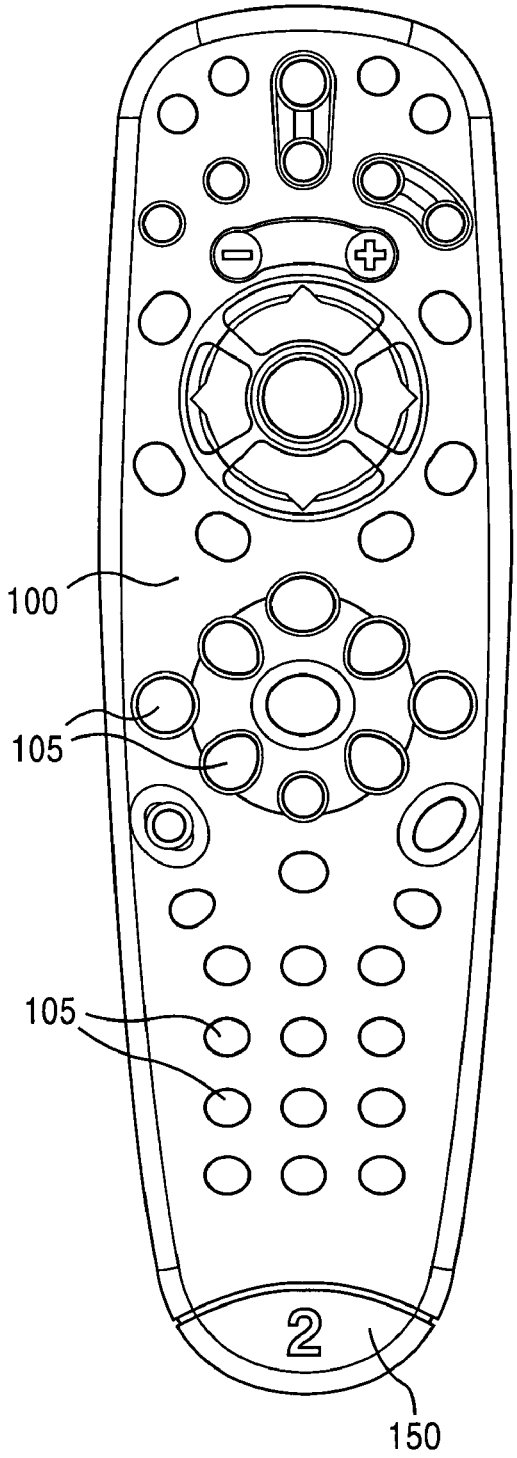
FIG. 1A is a front view of a remote controller of an embodiment of the present invention.

A remote controller according to the present invention has a sliding switch. Such sliding switches are commercially available, e.g. SSSS8 series (trade name) of ALPS Electric Co.

The sliding switch includes more than two contacting positions which are linearly disposed. For the use of the present invention a switch with three or four positions are preferable.

In order to change the position of the 4-position switch with the key, a special cap called "slider" is placed over the sliding lever of the switch. The slider can be made of a plastic or any other material, preferably made of plastic with small friction property, e.g., polyoxymethylene (POM).

The sliding contact has a slider with an angle portion. The angle between 45 degrees to 90 degrees is preferable for the angle of the angle portion of the slider. The angle portion preferably has round end and curved side such that the angle portion smoothly contacts with the notch surfaces of the cam pieces.

The cam pieces used in the present invention have a notch to fit the angle portion of the slider of the sliding contact. The remote controller has a slit to insert the insert portion of the cam piece. The first cam piece corresponds to one or two of the contacting positions located in a central portion of the sliding switch. If the first cam piece has a V-shaped notch in the center, the first cam piece can have only one position corresponding to the contacting position of the sliding switch because the notch position is the same on the first side and the second reverse side. If the first cam piece has the notch slightly off the center, the first cam piece can have two positions corresponding to the central two contacting positions of the sliding switch, one corresponding to first side and the reverse side of the first cam piece.

Similarly, the second cam piece has a V-shaped notch to fit the angle portion of the slider. The second cam piece has a notch more remote from the center of the cam piece than the notch of the first cam piece corresponding to slide positions of the switch.

Thus, if the first cam piece has only corresponding contact position, the two cam pieces can switch three sliding positions of the sliding switch. If the first cam piece has two corresponding contact positions, the two cam pieces can switch four sliding positions.

Thus, there can be two different cam pieces to set four positions of the 4-position switch. Each cam has a unique profile that can set the switch in one position one side, and when the cam piece is flipped over, it can set the switch in a second position.

If different colors and or characters are used for the sides of the cam pieces to indicate the corresponding mode, users can easily identify the switch position mode. If the mode is indicated by the colors, it would be preferable to use different color for the different sides of the same cam piece.

The remote controller can be designed to provide a holder for the cam piece within its body. Such a cam piece holder can be made inside of a battery cover.

Figure 1B:
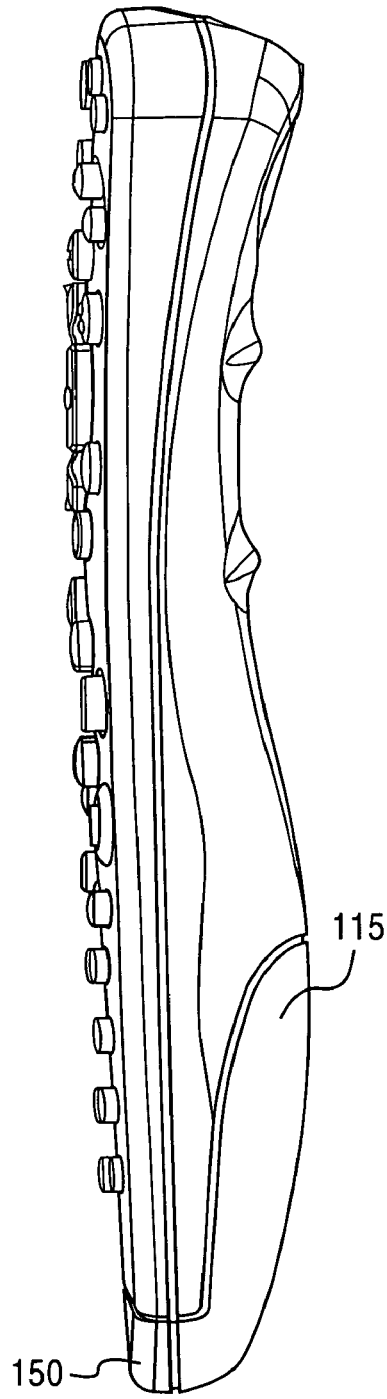
FIG. 1B is a right-side view of a remote controller of an embodiment of the present invention.
Figure 1C:
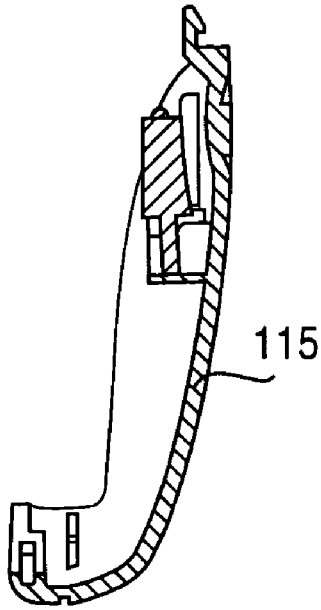
FIG. 1C is a cross-sectional view of the battery cover shown in FIG. 1D along 1C—1C.
Figure 1D:
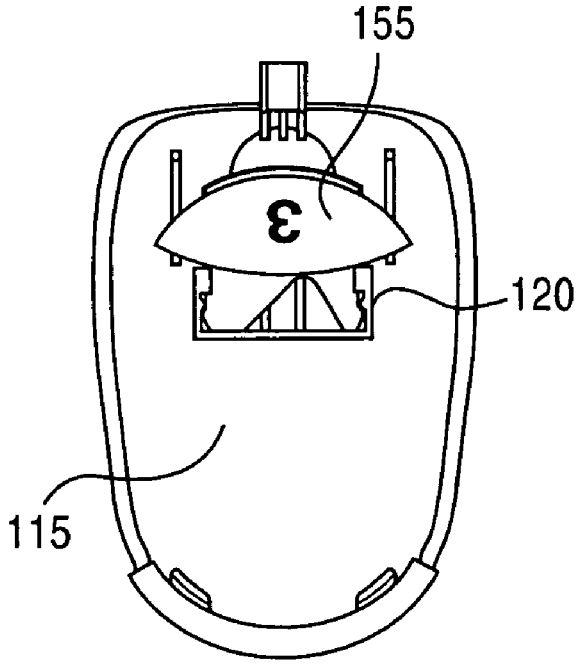
FIG. 1D is a front view of a battery cover of a remote controller of an embodiment of the present invention.

FIG. 1A is a front view of a remote controller of an embodiment of the present invention and FIG. 1B is a right-side view of a remote controller of an embodiment of the present invention. The remote controller can be for any kind of audio/visual equipments, such as a television set, a video cassette recorder, a stereo set, etc. The remote controller 100 has many operational buttons 105 on its front surface. The remote controller 100 has a slit at the lower end to insert an insert portion of a cam piece 150. The remote controller 100 has a first cam piece 150 at its end, which is detachably inserted in the slit (not shown) at the lower end. How the cam piece works will be later explained in more detail.

The remote controller 100 can be designed to provide a cam piece holder within its body. By providing a cam piece holder, misplacing of unused cam piece is prevented. Such a cam piece holder can be provided inside of a battery cover. The remote controller 100 has a battery cover 115 on its rear side. The battery cover is capable of being detached from the body of the remote controller. The structure and mechanism of detachably attached battery cover is well known in the art.

The battery cover 115 has a cam piece holder 120 inside of the battery cover. While a first cam piece 150 is in use, a second cam piece 125 can be stored by the cam piece holder 120 inside the battery cover 115.

Figure 2A:
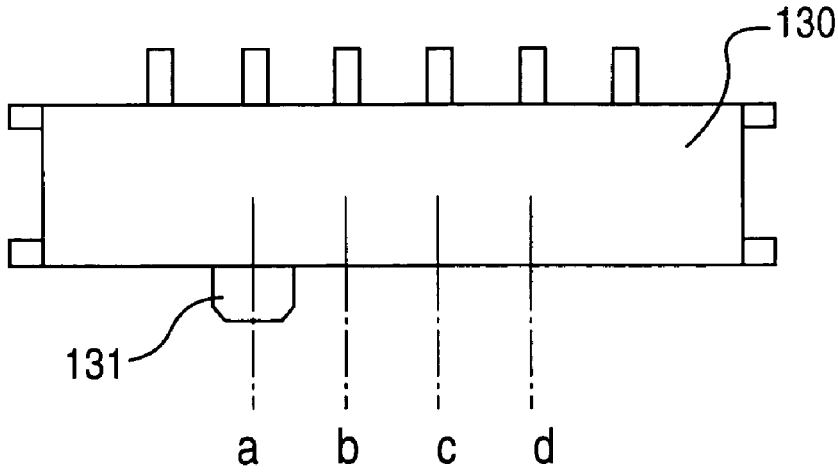
FIG. 2A is a schematic view of a sliding switch used in an embodiment of the present invention.

FIG. 2A is a schematic view of a sliding switch used in an embodiment of the present invention. The sliding switch 130 has a sliding lever 131 which slides along the sliding switch 130. The sliding lever 131 can take more than two positions which are linearly disposed. According to this embodiment, the sliding lever 131 can take four positions, a, b, c, d. Each position a, b, c, d of the sliding lever 131 corresponds to a different mode.

Figure 2B:
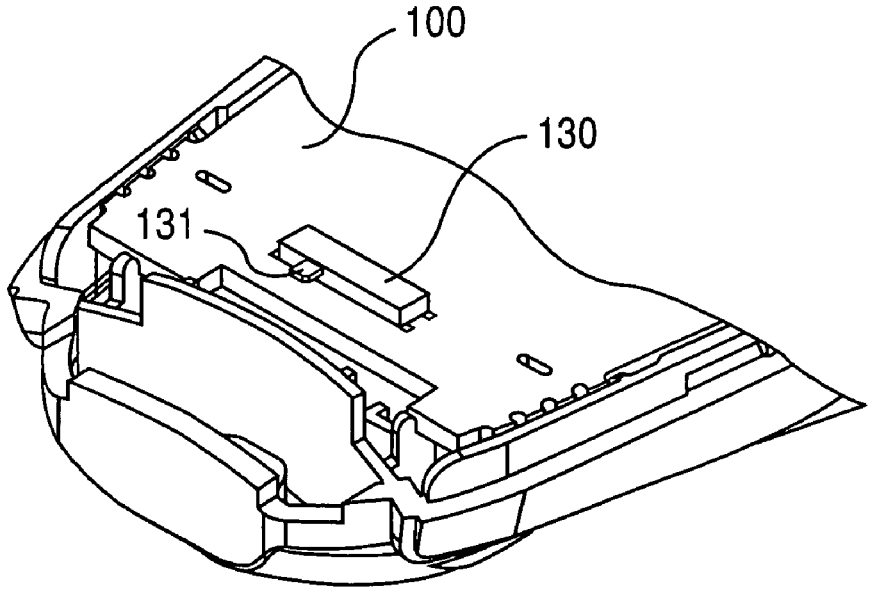
FIG. 2B is a schematic perspective view of inside a remote controller of an embodiment of the present invention showing a sliding switch mounted.

FIG. 2B is a schematic perspective view of inside of a remote controller of an embodiment of the present invention showing a sliding switch mounted. The sliding switch 130 is mounted inside a remote controller 100. To the sliding lever 131 a slider 140 (described below) is attached.

Figure 3A:
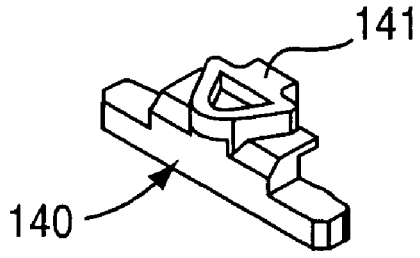
FIG. 3A is a perspective view of a slider of a sliding switch used in an embodiment of the present invention.
Figure 3B:
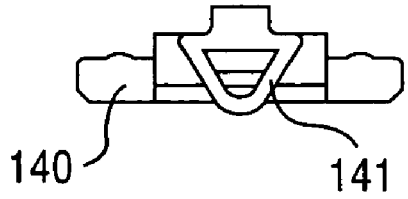
FIG. 3B is a plan view of a slider of a sliding switch used in an embodiment of the present invention.

FIG. 3A is a perspective view of a slider of a sliding switch used in an embodiment of the present invention. FIG. 3B is a plan view of a slider of a sliding switch used in an embodiment of the present invention. Slider 140 facilitates movement of the sliding lever 131 from one position to another position. Slider 140 has an angle portion 141. For slider 140, a material with low friction property is preferable. Polyoxymethylene (POM) is an example of such a material with low friction property.

Figure 3C:
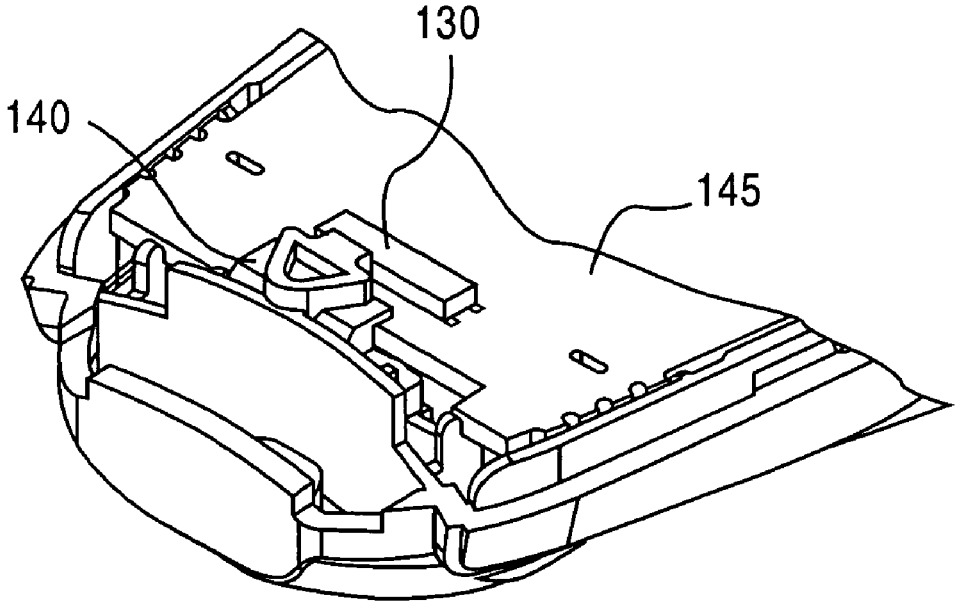
FIG. 3C is a schematic perspective view of inside the remote controller of an embodiment of the present invention showing a slider mounted.

FIG. 3C is a perspective view of inside the remote controller of an embodiment of the present invention showing a slider mounted on printed circuit board 145. The slider 140 engages and slides together with sliding lever 131 (not shown in FIG. 3C).

Figure 4A:
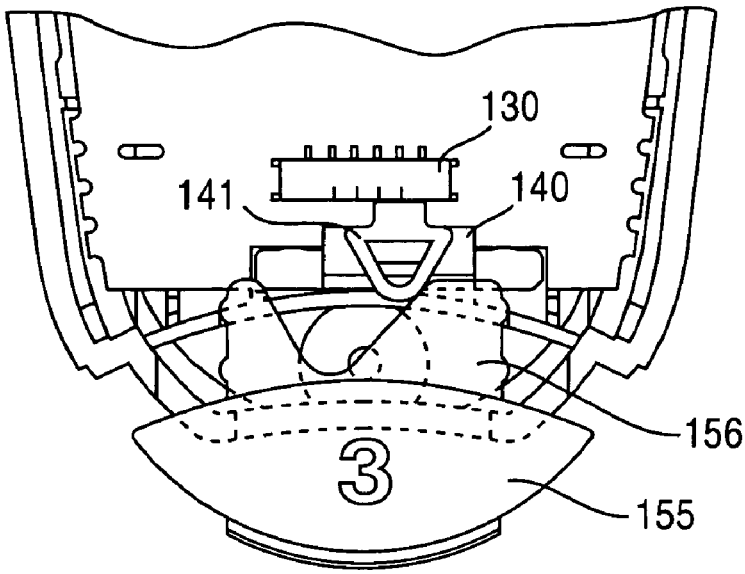
FIGS. 4A and 4B show how a cam piece changes the position of a slider according to an embodiment of the present invention resulting in the change of the position of the lever of the sliding switch.
Figure 4B:
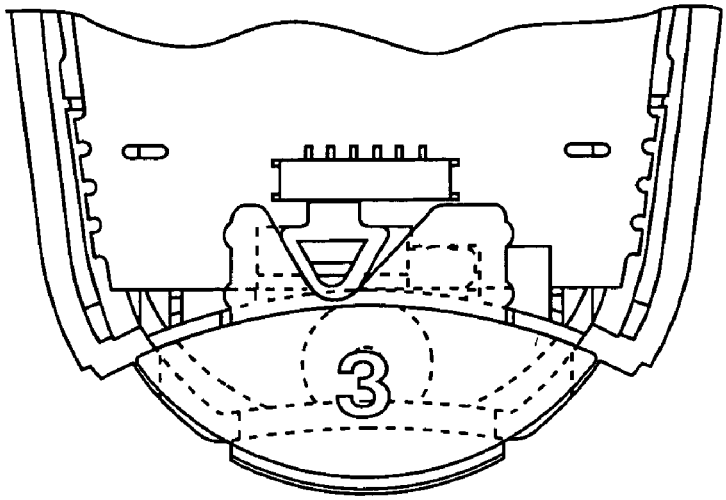

FIGS. 4A and 4B show how a cam piece changes the position of a slider according to an embodiment of the present invention to change the position of the sliding lever 131 of the sliding switch 130.

FIG. 4A shows slider 140 which is positioned such that sliding lever 131 (not shown in FIG. 4A) is positioned at position d. Cam piece 155 is inserted from downside through a slit and a V-shaped notch surface of insert portion 156 of cam piece 155 contacts angle portion 141 of the slider 140. As cam piece 155 is further inserted toward angle portion 141 of slider 140, the slider 140 is pushed by the V-shaped notch surface and moves along sliding switch 130, e.g. leftward in FIG. 4A. Cam piece 155 is stopped when cam piece 155 is fully inserted in the slit as shown in FIG. 4B. Here, the top of angle portion of slider 140 contacts the bottom of the V-shaped notch, and slider arrives at the position and sliding lever 131 of sliding switch 130 is positioned at position a.

Figure 5A:
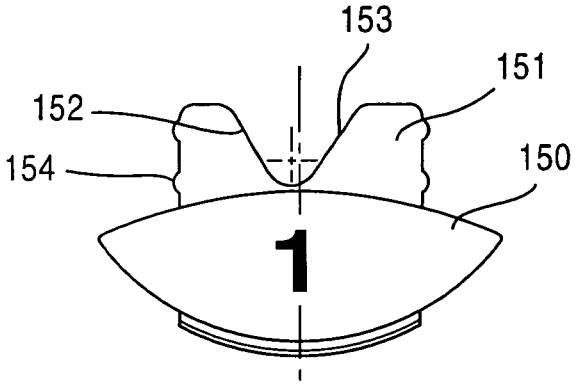
FIG. 5A shows a first side of a first cam piece for a sliding switch used in an embodiment of the present invention.
Figure 5B:
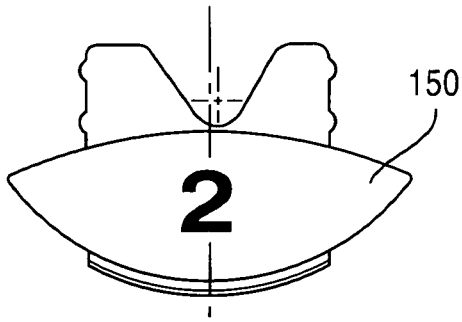
FIG. 5B shows a second side of a cam piece for a sliding switch used in an embodiment of the present invention.
Figure 5C:
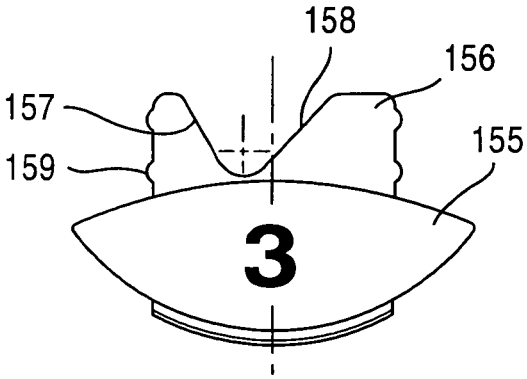
FIG. 5C shows a first side of a second cam piece for a sliding switch used in an embodiment of the present invention.
Figure 5D:
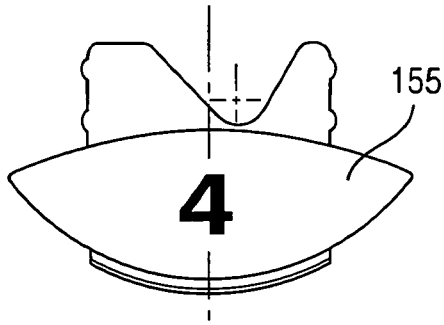
FIG. 5D shows a second side of a second cam piece for a sliding switch used in an embodiment of the present invention.

A cam piece can have one or two corresponding sliding lever positions of the sliding switch. FIG. 5A shows a first side of a first cam piece for a sliding switch used in an embodiment of the present invention. FIG. 5B shows a second side of the first cam piece. FIG. 5C shows a first side of a second cam piece for a sliding switch used in an embodiment of the present invention. FIG. 5D shows a second side of the second cam piece. The first side of a first cam piece can correspond to position b of the sliding lever 131 of the sliding switch 130, and the second side of the first cam piece can correspond to position c. Similarly, the first side of the second cam piece can correspond to position a, and the second side of the second cam piece can correspond to position d.

When angle portion 141 of the slider 140 is 60 degrees, it is preferable that the surface 152, 157 of the V-shaped notch on the further side from the center of cam piece 150, 155 has an angle of 30 degrees with respect to the perpendicular line. The angle of surface 153, 158 of V-shaped notch on the closer side from the center varies depending on the distance of the position of the sliding lever and the depth of insertion of V-shaped notch of insert portion 151, 156. An angle of 60 degrees or less with respect to the perpendicular line is preferable to make the slider 140 smoothly. An angle of 50 degrees or less with respect to the perpendicular line is more preferable. An angle of 45 degrees or less with respect to the perpendicular line is further more preferable.

Insert portion 151, 156 can have a slight protrusion 154, 159. The slight protrusion should be made to fit the wall of the slit to prevent cam piece 150, 155 from coming off the slit.

FIGS. 6A to 6D are schematic views explaining the function of each side of the cam pieces with the sliding switch according to an embodiment of the present invention. Two or more cam pieces can be used for the sliding switch. Each cam piece has a V-shaped notch to fit the angle portion 141 of the slider attached to the sliding lever of the sliding switch.

The first cam piece 150 corresponds to one or two of the contacting positions located in a central portion of the sliding switch. If the first cam piece 150 has the V-shaped notch in the center, the first cam 150 can have only one position corresponding to the contacting position in the center of the sliding switch 130. If the first cam piece 150 has the V-shaped notch slightly off the center, the first cam piece 150 can have two positions corresponding to the central two contacting positions of the sliding switch 130, one corresponding to first side and the other reverse side of the first cam piece.

Figure 6A:
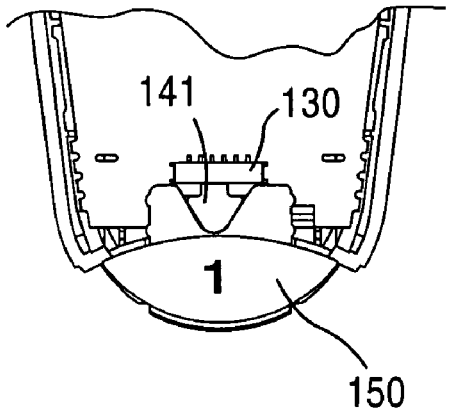
FIGS. 6A to 6D show schematic views of inside the remote controller according to an embodiment of the present invention showing the function of the cam pieces with a sliding switch.
Figure 6B:
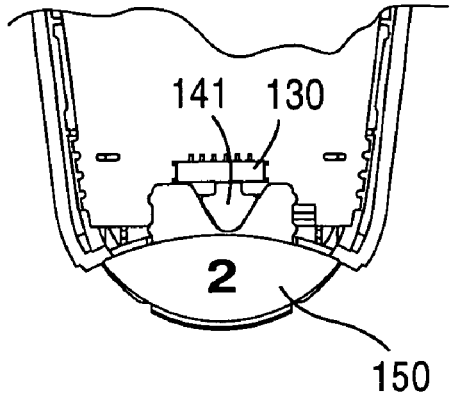

Each of FIGS. 6A to 6D shows the relationship between the position of the sliding switch and each side of the cam pieces. FIGS. 6A and 6B show the two positions using the first cam piece 150. The first cam piece 150 has side 1 and side 2. When the first cam piece 150 is inserted with side 1 up, the slider of the sliding switch 130 is set at position b as shown in FIG. 6A. When the first cam piece 150 is reversed and inserted with side 2 up, the slider of the sliding switch 130 is set at position c as shown in FIG. 6B.

Figure 6C:
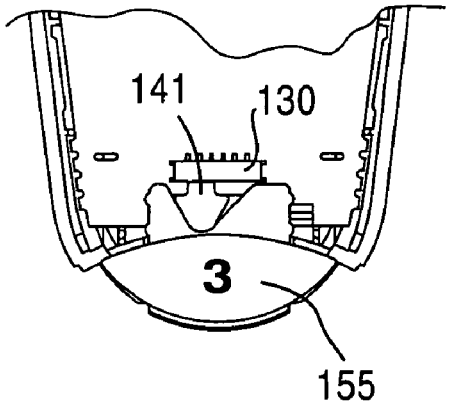
Figure 6D:
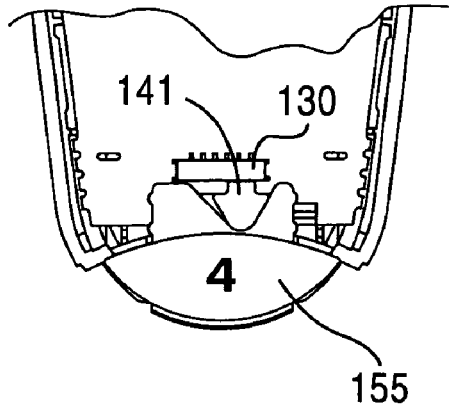

FIGS. 6C and 6D show the two positions using the second cam piece. The second cam piece 155 has the notch more remotely off the center line than the notch of the first cam piece corresponding to slide positions of the switch. The second cam piece 155 has side 3 and side 4. When the second cam piece 155 is inserted with side 3 up, the slider of the sliding switch 130 is set at position a as shown in FIG. 6C. When the second cam piece is reversed and inserted with side 4 up, the slider of the sliding switch 130 is set at position d as shown in FIG. 6D.

Thus, if the first cam piece has two corresponding contact positions, the two cam pieces 150 and 155 can switch four sliding positions. If the first cam piece 150 has only corresponding contact position, the two cam pieces can switch three sliding positions of the sliding switch.

The following advantages can be achieved according to the present invention:

A desired mode is easily obtained by using the cam piece with designated numbered face, thereby appropriately positioning the sliding switch without mistake. Thus, a foolproof setting is achieved.

Because the sliding switch is hidden inside the remote controller, position of the sliding switch is not unwittingly changed by other means than using the cam piece. Thus, this arrangement prevents users from tampering with switch position.

The cam piece can be made of different material or of different color than those of the body of the remote controller. The cam piece can give accent for the design of the remote controller.

One cam piece can set two different positions by just flipping the piece. Thus, two cam pieces with two different profiles can set up to four different positions of a sliding switch.

We claim:

1. A remote controller, comprising:

a sliding switch comprising more than two contacting positions linearly disposed, and a sliding lever to switch among the contacting positions; and a slider engaged with the sliding lever, the slider having an angle portion;

a first cam piece having a first V-shaped notch to fit the angle portion of the slider, the first cam piece corresponding to one or two of the contacting positions located in a central portion of the sliding switch;

a second cam piece having a second V-shaped notch to fit the angle portion, the second cam piece corresponding to two of the contacting positions located on side portions of the sliding switch.

2. The remote controller according to claim 1, wherein the first cam piece corresponds to one contact position.

3. The remote controller according to claim 1, wherein the first cam piece corresponds to two contact positions.

4. The remote controller according to claim 1, wherein the remote controller comprises a storage space for one of the first or second cam.

5. The remote controller according to claim 4, wherein the remote controller comprises a battery cover, wherein the storage space is disposed inside of the battery cover.

6. The remote controller according to claim 1, wherein the first cam piece or second cam piece is inserted through a slit formed in a body of the remote controller.

7. The remote controller according to claim 6, wherein the first and second cam pieces comprises a projection, and the slit has a wall to fit the projection of the cam pieces.

* * * * *